US005636789A

United States Patent [19]

Shook

[11] Patent Number: 5,636,789

[45] Date of Patent: Jun. 10, 1997

[54] FLUID DELIVERY SYSTEM

[75] Inventor: Forrest A. Shook, Fenton, Mich.

[73] Assignee: NLB Corp, Wixom, Mich.

[21] Appl. No.: 432,089

[22] Filed: May 1, 1995

[51] Int. Cl.[6] ..... B05B 9/00

[52] U.S. Cl. ..... 239/124; 239/526; 239/530

[58] Field of Search ..... 239/525, 526, 239/124; 251/322, 323, 333, 103–109, 251, 262, 263, 231; 137/861, 883

[56] References Cited

U.S. PATENT DOCUMENTS

| | | | |
|---|---|---|---|
| 601,639 | 4/1898 | Doyle | 239/525 X |
| 2,308,347 | 1/1943 | Asselin . | |
| 2,937,813 | 5/1960 | Rinkewich | 239/526 X |
| 3,147,767 | 9/1964 | Goss . | |
| 3,181,474 | 5/1965 | Yohpe . | |
| 3,394,890 | 7/1968 | Heinrich et al. . | |
| 3,395,722 | 8/1968 | Heinrich . | |
| 3,614,060 | 10/1971 | Freed et al. . | |
| 3,670,967 | 6/1972 | Fahlin et al. | 239/525 X |
| 3,672,575 | 6/1972 | Hinrichs . | |
| 3,679,332 | 7/1972 | Yohpe . | |
| 3,698,422 | 10/1972 | Freed et al. . | |
| 3,765,607 | 10/1973 | Pacht | 239/124 |
| 3,799,440 | 3/1974 | Goss et al. | 239/288 X |
| 3,802,628 | 4/1974 | Goss et al. . | |
| 3,885,739 | 5/1975 | Tuttle . | |
| 3,986,523 | 10/1976 | Pacht . | |
| 3,987,963 | 10/1976 | Pacht . | |
| 4,017,576 | 4/1977 | Freed et al. . | |
| 4,136,854 | 1/1979 | Ehmig et al. . | |
| 4,349,154 | 9/1982 | Pacht . | |
| 4,408,791 | 10/1983 | Griffin et al. | 239/526 X |
| 4,602,740 | 7/1986 | Stachowiak . | |
| 4,784,330 | 11/1988 | Hammelmann | 239/DIG. 22 X |
| 5,176,327 | 1/1993 | Petersen et al. | 239/526 |
| 5,199,642 | 4/1993 | Rankin | 239/124 |
| 5,253,808 | 10/1993 | Pacht | 239/124 |

FOREIGN PATENT DOCUMENTS

| | | | |
|---|---|---|---|
| 2804844 | 8/1979 | Germany | 239/526 |

*Primary Examiner*—Kevin Weldon

*Attorney, Agent, or Firm*—Dykema Gossett PLLC

[57] ABSTRACT

The high pressure water cleaning lance or apparatus has a main channel with a high velocity nozzle at one end and a water dumping channel provided with a dump valve. The apparatus also includes a trigger control valve mechanism which is operated to direct water under extremely high pressure to the nozzle. A removable quick release pin connects the valve housing to the trigger housing. Removal of the release pin permits the operator to remove the valve assembly including a valve pin from the valve housing for repair or replacement purposes. The apparatus includes a trigger actuating lever carried on one end by the trigger housing for actuating the valve pin. The trigger actuating mechanism or assembly includes a lip and a cam surface which are spaced apart and are selectably engageable with a pair of opposed surfaces provided on the head of the valve pin. The trigger assembly also features a manual shut-off feature. In the unlikely event that the valve sticks open, all the operator has to do is push the trigger forward to open the dump valve.

8 Claims, 3 Drawing Sheets

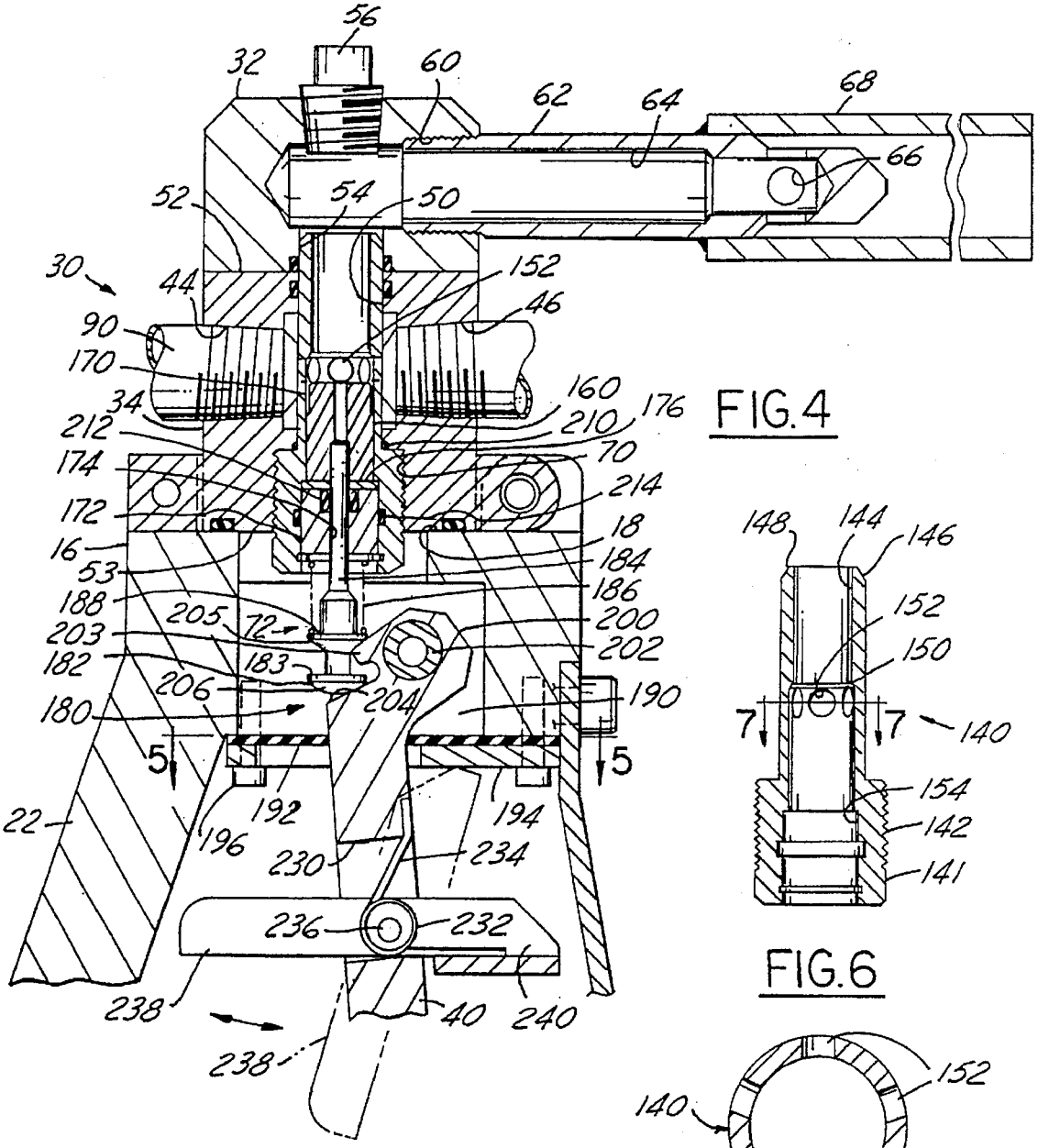
FIG.4
FIG.6
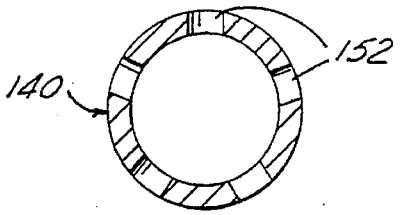
FIG.7
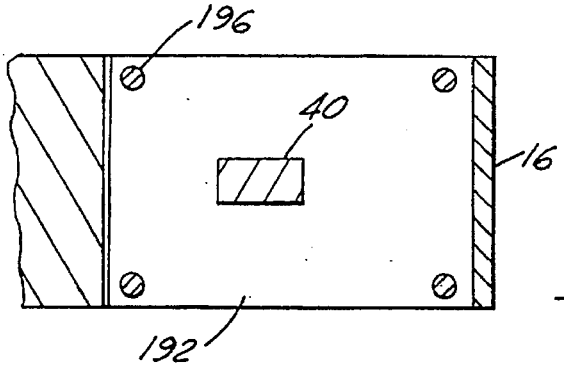
FIG.5

FLUID DELIVERY SYSTEM

FIELD OF THE INVENTION

This invention relates to a high pressure fluid delivery system and more particularly to a high pressure water cleaning lance whereby an operator holding the high pressure water cleaning lance may operate the trigger controlled valve mechanism to direct water under extremely high pressure to the discharge nozzle or may quickly reduce the velocity of the water by releasing the trigger and directing the water to the low pressure outlet of the device.

BACKGROUND OF THE INVENTION

Water under high pressure is used for various purposes. High pressure water is used in high pressure streams of water in fluid blast systems for cleaning purposes. Such high pressure systems are used for cleaning surfaces and for cleaning unwanted coatings or deposits off surfaces of various types particularly metal and concrete surfaces. In addition, it is well known to use water at high pressure for cleaning the interior surfaces of vessels and tubes particularly to remove scale and other deposits.

In the prior art, fluid systems are provided in which a high pressure stream of water is ejected at very high speeds. It is known that even a relatively small volume of water travelling at such a high speed, as an example, 800 feet per second, is capable of transferring tremendous momentum and is therefore extremely dangerous to human beings located within a short range of the cleaning lance or apparatus.

It is also well known that it is necessary for the operator of the high pressure water cleaning lance to be able to quickly reduce the velocity of the water issuing therefrom. The problems of the prior art and one solution is described in U.S. Pat. No. 3,672,575, issued Jun. 27, 1972, to Jack F. Hinrichs.

The cleaning lances of the prior art have certain disadvantages. In some devices because of the great pressure involved, the mechanical force required to depress the handle lever or trigger is so great that it makes the depression of the lever tiresome and therefore reduces the operating time of the nozzle. In addition, because of the high pressures involved, the cleaning lances of the prior art in certain cases leak after a relatively short period of use.

The present invention is designed and constructed for operator comfort and ease of operation in applications involving water pressures up to 40,000 psi. In addition, the novel lance weighs only 11 lbs. approximately vs. 17 lbs. for some prior art devices, making it easy to control and to operate for extended periods.

SUMMARY OF THE INVENTION

It is a feature of the present invention to provide a high pressure water apparatus in the form of a cleaning lance or gun which includes an adjustable shoulder stock and an adjustable hand grip which permit the operator to find convenient positions for the shoulder stock and hand grip to make the lance comfortable and suitable for use.

Another feature of the present invention is to provide an apparatus of the aforementioned type which includes a hand operated trigger which operates a valve which controls the flow between the high pressure main channel and the water dumping channel of the apparatus.

Still another feature of the present invention is to provide an apparatus of the aforementioned type which has a latch which is finger operated and is designed to prevent accidental actuation of the trigger.

A further feature of the present invention is to provide an apparatus of the aforementioned type wherein the trigger mechanism requires a very light trigger pull of only 3 lbs. to 7 lbs. to actuate the valve thereby assisting in reducing operator fatigue caused by operating the apparatus.

A still further feature of the present invention is to provide an apparatus of the aforementioned type wherein the trigger assembly includes a manual shut off feature in the unlikely event that the valve sticks in an open position. All the operator is required to do is push the trigger forward in order to operate the valve and thereby direct the high pressure water to the water dumping channel.

Still another feature of the present invention is to provide a high pressure water apparatus which includes a trigger housing having a flat surface with an opening therein and including a handle for holding the apparatus. Two pairs of spaced apart mounting lugs are provided at the comer of the flat surface, with the flat surface accommodating a valve housing having upper and lower flat surfaces, with the lower flat surface of the valve housing being seated on the flat surface of the trigger housing. The valve housing is provided with a pair of mounting elements projecting from the valve housing into the spaces between the aligned pair of mounting lugs.

A further feature of the present invention is to provide an apparatus of the aforementioned type wherein the valve housing is provided with an inlet port, an outlet port and a bypass port. An inlet conduit is connected to the inlet port and an outlet conduit is connected on one end thereof to the outlet port and has a high pressure, high velocity blasting nozzle at the other end thereof. With such a construction, the inlet and outlet conduits from a high pressure main channel. A water dumping tube assembly is connected to the bypass port and a cross channel connects the main channel to the water dumping channel. Valve means are disposed in the cross channel and has an open position and a close position for controlling the flow of water therethrough.

A still further feature of the present invention is to provide an apparatus of the aforementioned type wherein the trigger housing has a cavity, a trigger actuating lever is pivotally carried by the trigger housing on one end within the cavity for actuating the valve means. A pair of removable fastening means extend through aligned openings provided in the corresponding mounting elements and mounting lugs to thereby permit the valve housing to be open when one of the fastening means is removed to permit repair or replacement of the valve means in a timely fashion.

Another feature of the present invention is to provide an apparatus of the aforementioned type wherein a finger latch or lever is resiliently carried by the trigger actuating lever for holding the trigger actuating lever against inadvertent actuation to open the valve means and thereby direct flow through the high pressure main channel and nozzle.

Still another feature of the present invention is to provide an apparatus of the aforementioned type wherein the finger latch or ever is unlatched by a finger on an operator's hand which grips the handle to permit the trigger actuating lever to be actuated to open the valve means and direct flow through the high pressure main channel and nozzle.

A still further feature of the present invention is to provide an apparatus of the aforementioned type wherein the latch is provided with a pair of spaced apart arms, the trigger actuating lever extending between the arms, means are provided for pivotally connecting the latch to the trigger actuating lever and resilient means are interposed between the latch and trigger lever for biasing the trigger actuating lever in a direction to hold it against inadvertent actuation.

Another feature of the present invention is to provide an apparatus of the aforementioned type wherein the trigger housing further includes an L-shaped trigger guard with a pair of end portions, having one end portion attached to the bottom of the handle and having the other end portion attached to the trigger housing to thereby provide a guard for the trigger.

Still another feature of the present invention is to provide an apparatus of the aforementioned type wherein the trigger housing has a gasket and a cover for closing the cavity within the trigger housing and through which the trigger actuating lever extends, the gasket assisting in preventing dirt and foreign particles from entering the cavity and interfering with the valve means.

A further feature of the present invention is to provide an apparatus of the aforementioned type which is designed for operator comfort and ease of operation in applications involving water pressures up to 40,000 psi.

A still further feature of the present invention is to provide an apparatus of the aforementioned type which is easy to assemble and disassemble; is easy to maintain in the field; and is efficient in operation.

BRIEF DESCRIPTION OF THE DRAWINGS

FIG. 4 is a sectional view through the valve and trigger housings taken on the line 4—4 of FIG. 1.

FIG. 5 is a fragmentary sectional view taken on the lines 5—5 of FIG. 4.

FIG. 6 is a cross-sectional view through the valve cylinder.

FIG. 7 is a sectional view through the valve cylinder taken on the line 7—7 of FIG. 6.

DETAILED DESCRIPTION OF A PREFERRED EMBODIMENT

Figures 1, 2, 3:
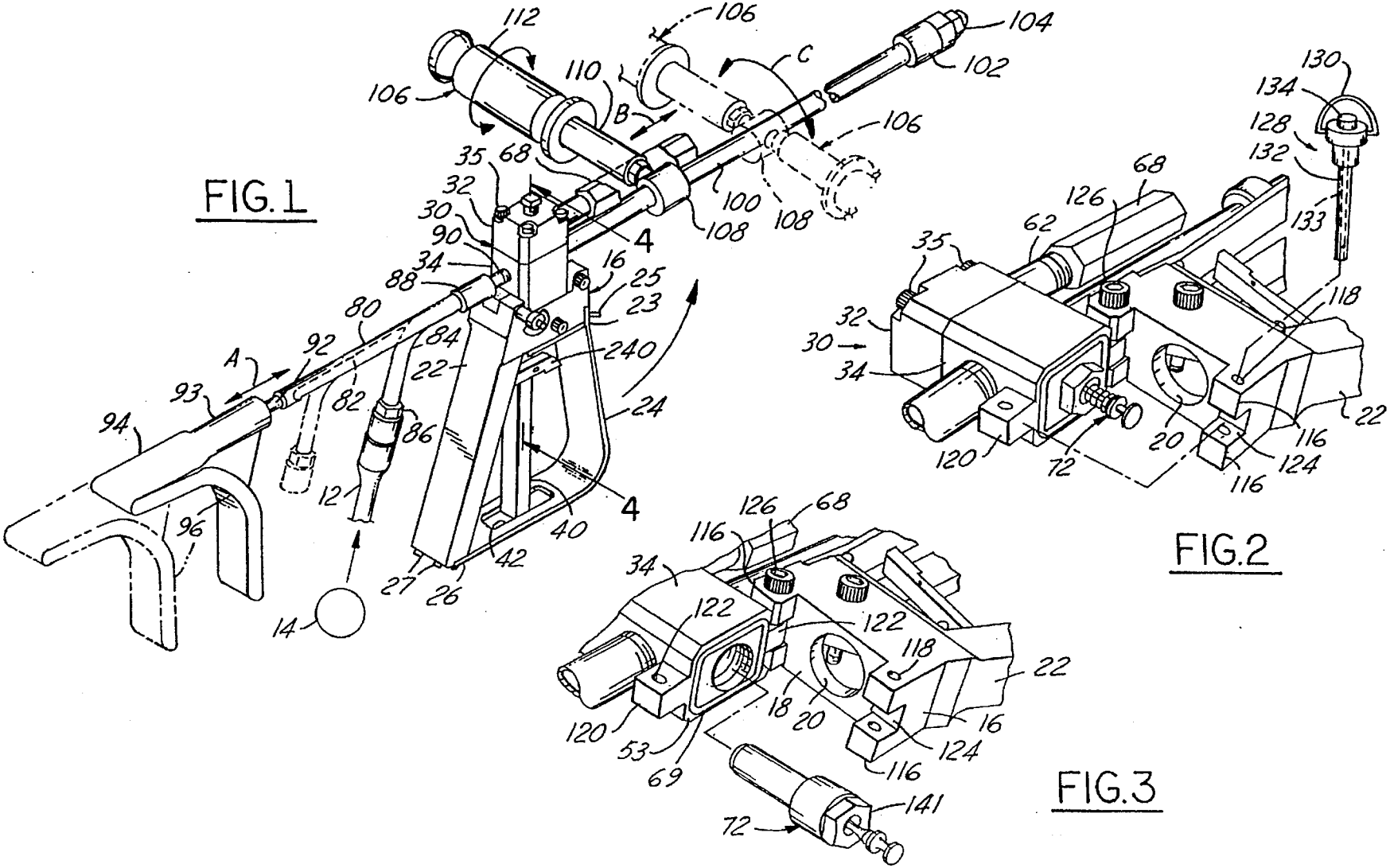
FIG. 1 is a perspective view of the high pressure water apparatus or cleaning lance.
FIG. 2 is a fragmentary perspective view showing the manner in which the valve housing is pivotally connected to the trigger housing.
FIG. 3 is a perspective view similar to FIG. 2 and showing the manner in which the seal valve cartridge assembly may be removed from and replaced with respect to the valve housing.

Referring now to FIG. 1 of the drawings, a fluid delivery system of this invention is illustrated and disclosed as including a cleaning lance or dump gun 10 connected through a conduit 12 to the outlet of a high pressure pump 14 which, as an example, is driven by a diesel powered or electrical power unit, not shown, and is capable of delivering fluid pressures in excess of 10,000 psi up to 40,000 psi for cleaning applications.

The cleaning lance 10 includes a trigger housing 16 having a flat upper surface 18 with a generally centrally located valve opening 20 therein. The trigger housing 16 further includes a hand grip or handle portion 22 and a trigger guard 24 of L-shaped configuration having one end portion 23 provided on the vertical leg attached to the housing 16 by a plurality of fasteners 25. The other end portion 26 provided on the horizontal leg of the trigger guard 24 is attached by a plurality of fasteners 27 to the bottom of the handle 22 as best shown in FIG. 1.

The valve mechanism 30 includes an upper housing part or cap 32 and a lower housing part 34 which are connected together at the corners by bolts 35. The valve mechanism includes a seal cartridge assembly to be hereinafter described which is actuated by the trigger actuating lever 40 as shown in FIG. 4. The bottom arm or leg of the trigger guard 24 is provided with an elongated slot 42 (FIG. 1) which receives the lower unattached end of the trigger 40. The trigger 40 operates the valve cartridge assembly to divert the flow of water from the low pressure or dump outlet to the high pressure outlet.

Specifically, valve mechanism 30 as shown in FIG. 4 is provided with a threaded inlet 44 and a threaded outlet 46 which are located in the lower housing part 34 at opposite sides thereof. The valve body or part 34 has a centrally located bore 50 extending from the upper surface 52 of lower part 34 to the lower flat surface 53 which is seated against the flat surface is provided on the trigger housing 16. The centrally located bore 50 is aligned with a bore 54 provided in the upper housing part 32. The bore 54 is actually aligned with the bore 50 of housing part 34. The upper end of the bore 54 is closed by a threaded plug 56. The upper housing part 32 is provided with a low pressure threaded outlet 60 which is designed to receive a conduit 62 forming a low pressure or water dumping channel 64. The channel 64 terminates in a plurality of orifices 66. The orifices 66 are surrounded by a safety shield 68. A gasket or sealing ring 69 is provided in the lower surface 53 of housing part 34.

The lower housing part 34 of the valve mechanism 30 has the lower end of the bore 50 enlarged and threaded at 70. A seal valve cartridge assembly 72 is inserted into the axial bore 50. Prior to describing the cartridge assembly 72 and the operation of the cleaning lance 10, other component parts of the lance will be described.

An elongated stainless steel tube 80 has an elongated slot 82 in the bottom to accommodate the pipe or inlet conduit 84 which is connected by a coupler 86 to the conduit 12. The leading end of the tube 80 is provided in a collar 88 having a threaded element 90 secured to the inlet 44 of the lower housing part 34.

The trailing end of the tube 80 is provided with a threaded nipple 92 which carries a shoulder support 94. The support 94 has a threaded body 93 which receives the threaded nipple 92 and further has a curved shoulder surface 96 which conforms to a person's shoulder. The collar 88 may be threadably adjusted to shorten or lengthen the distance between the shoulder support 94 and the valve housing parts 32, 34 to accommodate the operator to find the position which is most comfortable and suitable. The longitudinal adjustment of the shoulder support is represented by the double arrow line A in FIG. 1.

The threaded outlet 46 of housing part 34 is provided with an elongated stainless steel discharge barrel 100 having one end threaded into the threaded outlet 46 and the other end being provided with an adapter 102 and a high pressure high velocity blaster nozzle 104 which is threadably carried by the adapter. The barrel 100 is further provided with an adjustable handle assembly 106 including a collar 108 which is sleeved on the barrel 100 and is movable longitudinally of the barrel as well as circumferentially of the barrel 100. The collar 108 is provided with a handle lock disc, not shown, and is threadable mounted on the handle assembly 110. A rubber or plastic handle grip 112 is sleeved over the handle assembly 110. The hand grip 112 is adjustable by rotatively unfastening the handle assembly to thereby unloosen the collar 108 and thereby permit the collar 108 to move lengthwise and/or circumferentially of the barrel 100 to allow the operator to use the lance depending on whether the operator is left or right handed and further to allow the operator to find the lengthwise position which is most comfortable and suitable. Arrows B and C represent the longitudinal and circumferential movements of the hand grip.

A feature of the invention is the ease of changing the valve parts which are contained in the cartridge assembly 72. This is achieved by providing on the trigger housing 16 two pairs of spaced apart mounting lugs 116 with aligned holes 118. The lugs 116 are located at the comers of the fiat surface 18. The lower housing part 34 of the valve mechanism 30 is provided on opposite sides thereof with a pair of mounting elements 120 having holes 122. The mounting elements 120 are received in the spaces 124 between aligned lugs 116. A first pivot pin 126 is inserted in the aligned openings of the corresponding mounting lugs 116 and element 120 to pivotally connect the valve mechanism 30 to the trigger housing 16 as shown in FIGS. 2 and 3. When the valve mechanism 30 is seated on the surface 18 of the trigger housing 16 a quick release pin 128 having a handle 130 is inserted into the aligned holes 118, 122 of the other pair of mounting lugs 116 and the corresponding mounting element 120. The pin 128 has a tubular body 132 in which is located a movable center element 133, which is actuated by the push button 134 to effect locking engagement.

Referring now to the replaceable valve cartridge assembly 72, it includes an externally threaded cylinder 140 enlarged at one end and provided with a hex head 141 and with external threads 142 for threaded engagement with the threaded bore portion 70 of the valve housing part 34. The cylinder 140, as shown in FIGS. 6 and 7, includes a longitudinal bore 144 open at both ends. The leading end 146 is provided with a chamfer or bevel surface 148. The interior of bore 144 is enlarged to form a bevel valve seat 150 immediately above a plurality of radially extending circumferentially spaced orifices or openings 152 in the cylinder wall as shown in FIG. 7. The trailing end 142 of the cylinder 140 is provided with an enlarged bore 154. The cartridge assembly 12 further includes a piston 160 with a central opening 162 having an internal surface 164 intermediate the ends thereof. The leading end 168 of piston 160 is reduced in size to provide a relief area or space 170 between the piston 160 and the cylinder bore. The piston 160 has a chamfer end surface 161 and is movable in the bore to open or to close the openings or ports provided in the cylinder 140. The piston surface 161 conforms to the valve seat 152 to close the parts 152.

The cartridge assembly 72 further includes a bleed port pin guide 172 having an elongated opening 174. A seal retainer 176 is interposed between the piston 160 and the pin guide 172. An elongated axially movable bleed port pin 180 has an enlarged head 182 on one end of the stem 184. The stem 184 extends through or into the bores or openings provided in said guide 172 and piston 160. A spring 186 is interposed between the leading surface 188 of the head 182 for biasing the pin outwardly away from the ports 152.

The trigger housing 16 below the opening 20 is provided with an enlarged cavity 190 which is generally closed by a gasket 192 and a cover or plate 194 which are connected to the trigger housing 16 by a plurality of fasteners 196. The gasket 192 and plate 194 are each provided with a slot or opening for receiving the trigger 40 as shown in the drawings. The gasket 192 provides a seal around the trigger 40.

The upper end of the trigger 40 has an enlarged head 200 which is pivotally mounted on pivot pin 202 carried by the trigger housing 16. The trigger head 200 has an inclined or bevel cam actuating surface 204 which faces and is engageable to the outer surface 206 of the pin head 182 for moving the pin 180 inwardly to move the piston 160 in the same direction to close the openings or ports 152 upon sealing of the piston surface 161 with the cylinder seat 150.

The valve cartridge assembly 72 further includes O-rings or seals $210_s$ 212, 214 between the cartridge assembly 72 and the valve housing part 34. The piston 160 has a chamfer or bevel surface 151 on the leading end thereof which seats against the cylinder seat 150 after blocking the ports or openings 152.

A feature of the cleaning lance 10 is the ease and the manner of changing the valve cartridge assembly 72. It is of course recommended that a complete replacement cartridge 72 be available and that it be used as a spare cartridge in order to replace the existing cartridge assembly when required.

In order to replace the valve cartridge assembly 72, the cleaning lance 10 is placed on a support with the valve housing resting on the support and the trigger housing 16 facing upwardly. Thereafter, the quick release pin 128 is removed from the valve and trigger housings. This will permit or allow the trigger housing 16 including the handle 22 and trigger guard 24 along with the trigger 40 to swing away from the valve body as shown in FIG. 2. With the handle 22 swung away from the valve body, the valve cartridge assembly 72 is exposed as shown in FIG. 2 to allow removable of the cartridge with any open end, box or socket wrench or even with a pair of pliers which engage the hex head 141 of the cartridge 72. Thus, the cartridge assemble 72 is removed from the lower valve housing part 34 as shown in FIG. 3. Thereafter, a new replacement assembly is inserted into the valve housing. The valve cartridge assembly 72 is screwed into the body, tightened with a torque wrench and thereafter the handle and trigger assembly 16 is swung to its operating position. It is important to note that the trigger head 200 has a lip 203 which engages the bleed port pin 180 after the handle 22 and trigger housing 16 are in the operating position. Thereafter, the quick release pin 128 is inserted all the way through the trigger housing 16 in order to lock the valve body parts to the trigger housing 16.

Figure 8:
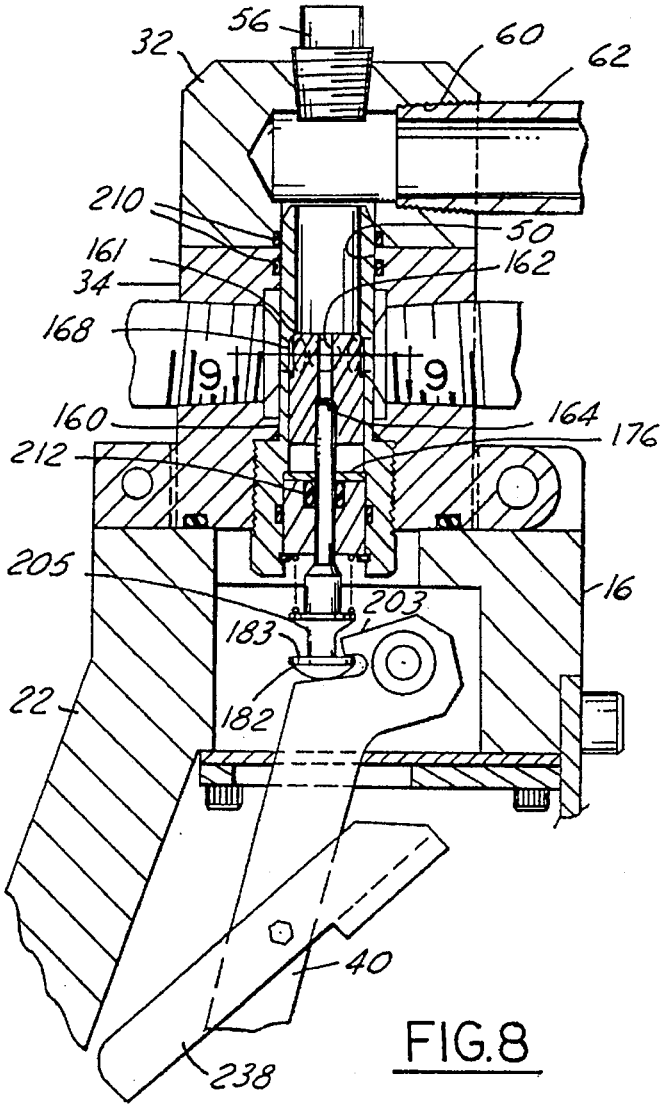
FIG. 8 is a fragmentary elevational view through the valve housing and trigger housing, with the seal cartridge assembly shown in section and further illustrating the manner in which the manual shut-off may be utilized in the unlikely event that the piston of the valve cartridge would stick and which permits the operator to push the trigger forward to open the dump valve.
Figure 9:
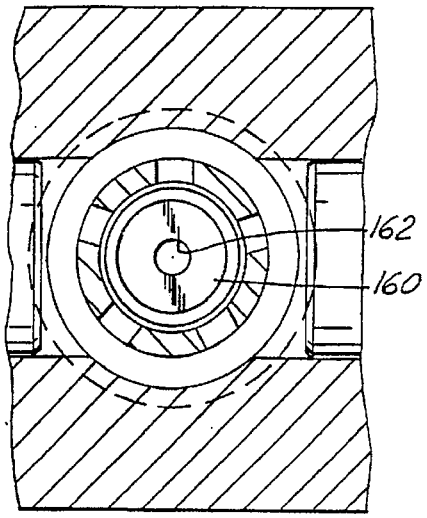
FIG. 9 is a fragmentary sectional view taken on the lines 9—9 of FIG. 8.

The trigger 40 provided with a slot 230 (FIG. 4) for a biasing spring 232 including an arm 234. The biasing spring 232 is carried by a pivot or fastener 236 which mounts a finger operated latch 238 on the trigger 40. The latch 238 includes a pair of spaced apart arms 240 which permits the latch 238 to straddle opposite sides of the trigger 40. The coil spring 232 is arranged to bias the lever or latch 238 to a generally horizontal position as shown in FIG. 4 in order to prevent inadvertent actuation of the trigger 40. When it is necessary to activate the trigger 40, the operator takes hold of the handle 22 of the housing 16 and utilizes one of his/her fingers to pivot the latch 238 to the position shown in dotted lines in FIG. 4 whereby the operator is in a position to actuate the mechanism causing high pressure water to be directed through the high pressure main channel and the nozzle 104. The operator hand or fingers remain on the latch 238 and trigger 40 while the high pressure water is being directed through the nozzle 104. Once the trigger 40 and the latch 238 are released, the spring 232 returns the trigger 40 and latch 238 to the position illustrated by the solid lines in FIG. 4 thereby opening the ports 152 of the valve mechanism. As a result thereof, the high pressure water is directed through the cross-channel leading to the water dumping channel 64 of the dump valve. In the event the piston 160 should stick and for some reason the ports 152 are not opened so as to dump the high pressure water, then the operator takes hold of the trigger 40 which may be in the position as shown in FIG. 8 and moves the trigger 40 to the right whereby the catch or lip 203 provided on the head 200 of trigger 40 engages the opposing surface 183 provided on the head 182 and as a result thereof, the valve stem 184 is moved downwardly thereby opening the ports 152 and the cross-channel leading to the water dump channel 64.

It now will be recognized that a new and improved fluid cleaning system has been disclosed. Since certain changes or modifications may be made in the disclosed embodiment without departing from the inventive concepts involved, it is the purpose of the following claims to define such changes and modifications which are within the scope of the present invention.

What I claim is:

1. A high pressure water apparatus comprising:

a high pressure main channel with a high pressure, high velocity blasting nozzle at the end, a water dumping channel with a low pressure outlet, a cross-channel connecting said main channel to said water dumping channel, valve means disposed within said cross-channel having an open position and a close position for controlling the flow of water therethrough, said valve means including an elongated cylinder having a bore extending from one end thereof to the other end, a plurality of openings located in the side wall of said cylinder between the ends thereof, a piston seat located in said bore adjacent said plurality of openings, a piston location in the bore of said cylinder and movable therein relative to said openings to open or close said cross-channel, said piston having a piston bore, an elongated pin having a head and a stem, with said stem movable in the bore of said piston to urge the piston against said piston seat to thereby block flow through said openings and close the flow of water through said cross-channel and said water dumping channel thereby permitting flow through said high pressure main channel and said nozzle, an actuating lever pivoted on one end thereof and including on said one end a lip and a cam surface which are spaced apart, said lip and said cam surface being engageable with a pair of opposed surfaces on said head, said actuating lever when moved in one direction urging said cam surface against one of the opposed surfaces on said head effective to move said pin and said piston against said piston seat to block flow through said cross channel and said water dumping channel, said actuating lever, in the event said valve means fail to open said openings and said cross-channel after said actuating lever is released, being manually operable when moved by the operator in the opposite direction to urge said lip against the other of said opposed surfaces on said head and thereby move said pin in a direction away from said piston seat, with said piston also moving away from said piston seat to open said openings, cross channel and said water dumping channel thereby directing the flow of water away from said high pressure main channel to said dumping channel.

2. A high pressure water apparatus comprising a trigger housing having a flat surface with an opening therein and including a handle for holding the apparatus, two pairs of spaced apart mounting lugs at the corners of said flat surface, a valve housing having upper and lower flat surfaces, with the lower flat surface of said valve housing seated on said flat surface of said trigger housing, said valve housing having a pair of mounting elements projecting from said valve housing into the spaces between aligned pairs of mounting lugs, said valve housing having an inlet port, an outlet port and a bypass port, an inlet conduit connected to said inlet port, an outlet conduit connected on one end thereof to said outlet port and having a high pressure, high velocity nozzle at the other end thereof, said inlet and outlet conduit forming a high pressure main channel, a water dumping tube assembly connected to said bypass port, a cross-channel connecting said main channel to said water dumping channel, valve means located in said cross-channel having an open position and a close position for controlling the flow of water therethrough, a trigger actuating lever pivotally carried on one end of said trigger housing for actuating said valve means, a pivot element extending through one of said pairs of spaced apart mounting lugs and the corresponding one of said pair of mounting elements to provide a pivot mounting for said trigger housing which opens and closes said valve housing, a removable quick release pin extending through the other of said pairs of spaced apart mounting lugs and the other of said pair of mounting elements when said flat surface of said trigger housing is seated against the lower flat surface of said valve housing to close said valve housing, and the removal of said release pin permitting said trigger housing to pivot approximately 90° about said pivot element and thereby move said flat surface of said trigger housing away from the lower flat surface of said valve housing to open said valve housing and thereby permit removal of said valve means from said valve housing for repair or replacement.

3. The high pressure water apparatus defined in claim 2, wherein a finger latch is resiliently carried by said trigger actuating lever for holding said trigger actuating lever against inadvertent actuation to open said valve means and thereby direct flow through said high pressure main channel and nozzle.

4. The high pressure water apparatus defined in claim 3, wherein said finger latch is unlatched by a finger on an operator's hand which grips said handle to permit the trigger actuating lever to be actuated to open said valve means and direct flow through said high pressure main channel and nozzle.

5. The high pressure water apparatus defined in claim 2, wherein a finger latch is provided with a pair of spaced apart arms, said trigger actuating lever extending between said arms, means for pivotally connecting said finger lever to said trigger actuating lever, and resilient means interposed between said levers for biasing said trigger actuating lever in a direction to hold it against inadvertent actuation.

6. The high pressure water apparatus defined in claim 2, wherein said trigger housing further includes an L-shaped trigger guard with a pair of end portions, having one end portion attached to the bottom of said handle and having the other end portion attached to said trigger housing.

7. The high pressure water apparatus defined in claim 2, wherein said trigger housing has a cavity, a gasket and a cover closing said cavity and through which said trigger actuating lever extends, said gasket assisting in preventing dirt and foreign particles for entering said cavity and interfering with said valve means.

8. The high pressure water apparatus defined in claim 2, wherein said valve means include an elongated cylinder in said cross-channel having a bore extending from one end thereof to the other end, a plurality of openings located in the side wall of said cylinder between the ends thereof, a piston seat located in said bore adjacent said plurality of openings, a piston located in the bore of said cylinder and movable therein relative to said openings to open or close said cross-channel, said piston having a piston bore, an elongated pin having a head and a stem, with said stem movable in the bore of said piston to urge the piston against said piston seat to thereby block flow through said openings and close the flow of water through said cross-channel and said water dumping channel thereby permitting flow through said high pressure main channel and said nozzle.

* * * * *